US007153790B2

(12) United States Patent
Böttger et al.

(10) Patent No.: US 7,153,790 B2
(45) **Date of Patent: *Dec. 26, 2006**

(54) PENETRATION-RESISTANT MATERIAL AND ARTICLES MADE OF THE SAME

(75) Inventors: Christian K. Böttger, Remscheid (DE); Rüdiger Hartert, Wuppertal (DE); Kurt R. Stolze, Leichlingen (DE); Achim G. Fels, Wuppertal (DE)

(73) Assignee: Teijin Twaron GmbH, Wuppertal (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/525,195

(22) PCT Filed: Sep. 2, 2003

(86) PCT No.: PCT/EP03/09709

§ 371 (c)(1),
(2), (4) Date: Feb. 18, 2005

(87) PCT Pub. No.: WO2004/023060

PCT Pub. Date: Mar. 18, 2004

(65) Prior Publication Data

US 2006/0073753 A1 Apr. 6, 2006

(30) Foreign Application Priority Data

Sep. 6, 2002 (EP) ..... 02020027

(51) Int. Cl.
*B32B 27/04* (2006.01)
*F41H 1/02* (2006.01)

(52) U.S. Cl. ..... 442/134; 2/2.5; 442/135; 442/149; 442/255; 442/263

(58) Field of Classification Search ..... 2/2.5; 442/85, 88, 134, 135, 149, 255, 263; 428/911
See application file for complete search history.

(56) References Cited

U.S. PATENT DOCUMENTS 4,608,717 A 9/1986 Dunbavand
5,344,956 A 9/1994 Allewaert et al.
5,471,906 A * 12/1995 Bachner et al. ..... 89/36.05
5,556,695 A 9/1996 Mazelsky
6,034,004 A 3/2000 Fels et al.
6,610,618 B1 8/2003 Böttger et al.

FOREIGN PATENT DOCUMENTS

| | | | |
|---|---|---|---|
| EP | 0 310 199 A1 | | 4/1989 |
| KR | 9401038 B | | 2/1994 |
| RU | 2096542 C1 | | 11/1997 |
| WO | WO 92/01108 | * | 1/1992 |
| WO | WO 00/42246 A1 | | 7/2000 |

* cited by examiner

*Primary Examiner*—Arti Singh
(74) *Attorney, Agent, or Firm*—Oliff & Berridge, PLC

(57) ABSTRACT

A penetration-resistant material is described to include at least a double layer of woven fabric, wherein the double layer includes a first layer of fabric composed of a first set of threads having 3.5 to 20 threads/cm, having a linear density of at least 210 dtex, and composing at least 65% of the first layer fabric weight, and a second set of threads comprising 0.5 to 16 threads/cm and having a linear density of at least 50 dtex, with the second set of threads being transverse to the first set of threads, and the ratio of the number of threads/cm of the first set to that of the second set is greater than 1:1, and a second layer of fabric composed of a first set of threads having 0.5 to 16 threads/cm and having a linear density of at least 50 dtex, and a second set of threads having 3.5 to 20 threads/cm, having a linear density of at least 210 dtex, and composing at least 65% of the second layer fabric weight, with the second set of threads being transverse to the first set of threads, and the ratio of the number of threads/cm of the second set to that of the first set is greater than 1:1. In the first layer of fabric at least the first set of threads, and in the second layer of fabric at least the second set of threads, are treated with a water-repellant.

23 Claims, 1 Drawing Sheet

PENETRATION-RESISTANT MATERIAL AND ARTICLES MADE OF THE SAME

CROSS-REFERENCE TO RELATED APPLICATION

This application is a U.S. national stage application of PCT/EP03/09709, filed Sep. 2, 2003, which PCT application is incorporated herein by reference in its entirety.

BACKGROUND

The invention pertains to a penetration-resistant material and to articles made of the same.

Penetration-resistant articles such as bulletproof vests, helmets, vehicle panels and shields prepared from high strength fibers are known in the art. For many applications, in particular for ballistic vests, the fibers are used in a woven or knitted fabric. This fabrics may be coated or impregnated in a matrix to obtain hard ballistic materials, or may be used free from matrix to obtain soft ballistic materials.

Bulletproof fabrics are known, inter alia, from EP 310 199. The fabrics disclosed therein are composed of filament yarns of ultrahigh molecular weight polymer having high strength and high modulus, with the warp threads being of a different polymeric material than the weft threads.

In Russian Patent RU 2 096 542, a ballistic fabric for bulletproof jackets was disclosed having warp and weft threads of poly para-phenyleneterephthalamide (PPTA) wherein the ratio of the warp to the weft linear density is smaller than 4.17. Typically, warp threads having a linear density of 143 to 588 dtex and weft threads having a linear density of 588 to 930 were disclosed, the weft threads having equal or higher linear density than the warp threads. It is particularly contended that ballistic fabrics having warp to weft linear density ratios between 1.59 and 4.17 have improved deflection properties.

In WO 00/42246, a penetration-resistant material is disclosed comprising at least a double layer of fabric composed of two layers of woven fabric which are cross-plied at an angle wherein the fabric is composed of a first set of threads comprising 3.5 to 20 threads/cm and having a linear density of at least 420 dtex, and a second set of threads comprising 0.5 to 8 threads/cm and having a linear density of at least 50 dtex, with the second set of threads being transverse to the first set of threads and wherein the ratio of the linear density of the first set of threads to the linear density of the second set of threads is greater than 4.2:1, more preferably greater than 7.5:1. In a preferred embodiment, the first set of threads is warp threads made of p-aramid yarn and the second set of threads is weft threads made of polyester yarn, and the ratio of the number of threads/cm of the first set to that of the second set is greater than 1:1. Although the ballistic performance of this material is excellent, the necessity of cross-plying the layers is a disadvantage in terms of ease and simplicity of the manufacture and the danger of creating weak points that inherently can occur in the process of cross-plying.

SUMMARY

So, the problem underlying the present invention is to provide a penetration-resistant material which does not exhibit the disadvantages of the prior art.

Some penetration-resistant materials exhibit a high uptake of water resulting in a decrease of ballistic performance. Therefore, another problem underlying the present invention is to reduce this drawback.

These problems are solved by a penetration-resistant material comprising at least a double layer of woven fabric wherein the double layer comprises a first layer of fabric composed of a first set of threads comprising 3.5 to 20 threads/cm, having a linear density of at least 210 dtex, and comprising at least 65% of the first layer fabric weight, and a second set of threads comprising 0.5 to 16 threads/cm and having a linear density of at least 50 dtex, with the second set of threads being transverse to the first set of threads, and the ratio of the number of threads/cm of the first set to that of the second set is greater than 1:1, and a second layer of fabric composed of a first set of threads comprising 0.5 to 16 threads/cm and having a linear density of at least 50 dtex, and a second set of threads comprising 3.5 to 20 threads/cm, having a linear density of at least 210 dtex, and comprising at least 65% of the second layer fabric weight, with the second set of threads being transverse to the first set of threads, and the ratio of the number of threads/cm of the second set to that of the first set is greater than 1:1, and wherein the first and second sets of threads of the first layer have a parallel orientation towards the first and second sets, respectively, of threads of the second layer, which penetration-resistant material is characterized in that in the first layer of fabric at least the first set of threads, and in the second layer of fabric at least the second set of threads, are treated with a water-repellant.

DETAILED DESCRIPTION OF EMBODIMENTS

Figure 1:
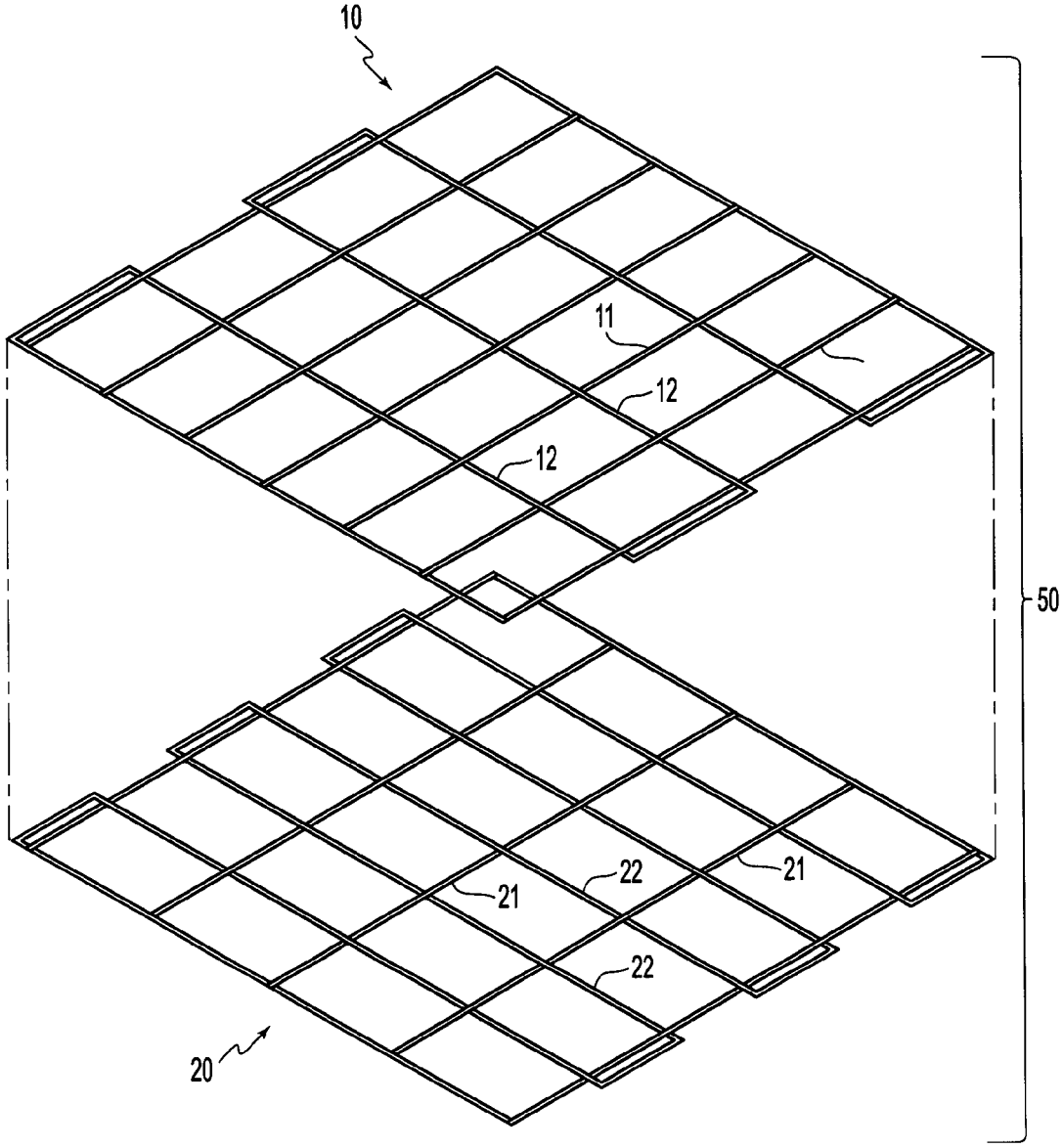
FIG. 1 shows a perspective exploded view of a double layer woven fabric 50 with a first layer 10 having a first set of threads 11 as warp threads and a second set of threads 12 as weft threads and a second layer 20 having a first set of threads 21 as warp threads and a second set of threads 22 as weft threads. At least the first set of threads 11 of the first layer and the second set of threads 22 of the second layer are treated with a water repellant.

Within the scope of the present invention the term "thread" means any sort of thread such as staple yarn, twisted staple yarn, twisted filament yarn, non-twisted intermingled yarn, and preferably, untwisted filament yarn.

In a preferred embodiment of the penetration-resistant material according to the present invention, in the first layer of fabric the first and the second set of threads, and in the second layer of fabric the first and the second set of threads, are treated with a water-repellant.

Within the scope of the present invention, in principle any substance which repels water and which can be applied to the threads with known methods can be used as the water-repellant. However, because of its high water-repellant efficiency, a water-repellant comprising fluorine and carbon atoms, e.g., a fluoropolymer, and especially a mixture of fluoroacrylate polymers, is preferred. Said mixture is for example contained in OLEOPHOBOL SM®, a water-repellant finish available from Ciba Spezialitätenchemie Pfersee GmbH, Langweid am Lech, DE.

In a preferred embodiment of the penetration-resistant material according to the present invention, the water-repellant treated threads comprise about 0.1 to about 2 weight % fluoroacrylate polymers with respect to the weight of the water-repellant treated threads. Especially preferred is about 1 weight % fluoroacrylate polymers with respect to the weight of the water-repellant treated threads.

Preferably, in the penetration-resistant material according to the present invention, at least the ratio of the linear density of the first set of threads to the linear density of the second set of threads of the first layer and of the linear density of the second set of threads to the linear density of the first set of threads of the second layer is >1, more preferably >4.2, and most preferably >5.9. A particular effective ratio is 6–6.6.

In a preferred embodiment of the penetration-resistant material according to the present invention, at least one of the second set of threads of the first layer and the first set of threads of the second layer comprises 0.5 to 8 threads/cm.

In each layer, the threads having a linear density of at least 210 dtex comprise at least 65% of the fabric weight of that layer. Preferably, these threads comprise at least 70% and more preferably 75% of the fabric weight of that layer.

The second set of threads is transverse to the first set of threads in each of the two layers. Usually these sets are about perpendicular to each another, but this is not necessary. The second set of threads may be provided under an angle other than 90° to the first set of threads. The two layers are secured together without cross-plying.

In a preferred embodiment of the penetration-resistant material according to the present invention, the threads of the layers of the double layer are bonded together, for instance, by stitch bonding, or preferably with an adhesive material. The adhesive material may be adhesive material provided onto the threads or onto the fabric, for instance as a finish.

The adhesive material can also be an adhesive layer provided between the two fabric layers of the double layer.

Adhesive materials include thermoplastic materials, for example polyolefins such as polyethylene and polypropylene, polyamide, polyester or mixtures of these materials, elastomeric materials, for example Kraton, rubber, silicon and the like, and thermoset materials, for example epoxy resins, polyester resins, phenolic resins, vinylester resins and the like.

It is also possible to use for at least part of the second set of threads of the first layer and the first set of threads of the second layer a material that melts under pressure and/or heating, thereby accomplishing binding of the sets of threads of the respective layers, and optionally also binding the two fabric layers together.

The number of threads per cm in the first set of threads of the first layer and the second set of threads of the second layer is 3.5 to 20 threads/cm, more preferably 4 to 15, threads/cm and most preferably 5 to 12 threads/cm.

The number of threads per cm in the second set of threads of the first layer and the first set of threads of the second layer is 0.5 to 16 threads/cm, preferably 0.5 to 8 threads/cm, more preferably 1 to 6 threads/cm and most preferably 2 to 4 threads/cm.

The first set of threads of the first layer (preferably warp threads) and the second set of threads of the second layer (preferably weft threads) are of high strength and high modulus.

In a preferred embodiment of the penetration-resistant material according to the present invention the first set of threads of the first layer and the second set of threads of the second layer consist of high tenacity threads selected from aramid, polyethylene and poly-p-phenylenebenzobisoxazole (PBO) threads, whereby for the aramid, preferably p-aramid threads and most preferably poly paraphenyleneterephthalamide (PPTA) is used, for example Twaron® threads manufactured by Teijin Twaron.

The penetration-resistant material according to the present invention also consists of a second set of threads of the first layer (preferably weft threads) and a first set of threads of the second layer (preferably warp threads), the yarn composition of which is not critical for the present invention. Preferably, however, these threads exhibit a high strength and a high modulus. This is particularly the case when the second set of threads of the first layer and the first set of threads of the second layer are selected from polyester, polyethylene, polypropylene and aramid threads, for example Twaron® threads manufactured by Teijin Twaron. Most preferably, the second set of threads of the first layer and the first set of threads of the second layer is made of polyester thread.

In a preferred embodiment of the penetration-resistant material according to the present invention, the warp and the weft threads are selected to be made of different polymers, for instance a fabric having warp threads of p-aramid yarn and weft threads of polyester yarn, or reversed, is preferred. An example for such a preferred embodiment is a penetration-resistant material wherein the first set of threads of the first layer and the second set of threads of the second layer consist of aramid threads, and the second set of threads of the first layer and the first set of threads of the second layer consist of polyester threads.

As long as the required linear density ratio is satisfied, the linear density of the first set of threads of the first layer and of the second set of threads of the second layer is selected to be at least about 210 dtex, preferably between 210 and 6720 dtex, more preferably between 420 and 3360 dtex, even more preferably between 420 and 1680 dtex and most preferably between 840 and 1100 dtex.

The linear density of the second set of threads of the first layer and the first set of threads of the second layer is at least 50 dtex. In a preferred embodiment of the penetration-resistant material according to the present invention, the linear density of the second set of threads of the first layer and of the first set of threads of the second layer is between about 50 and 280 dtex and most preferably between 80 and 140 dtex.

For reasons of efficient manufacturing of the penetration-resistant material according to the present invention, it is preferred that the first set of threads of the first layer and the first set of threads of the second layer are warp threads and the second set of threads of the first layer and the second set of threads of the second layer are weft threads.

In a preferred embodiment of the penetration-resistant material according to the present invention, the double layer exhibits two outer sides and at least one of the outer sides of the double layer is provided with a protective layer which can be a thermoplastic, thermoset or an elastomeric material or a mixture of these materials. The protective layer is applied to protect the fabric from damage by excessive abrasion and to improve the ballistic performance.

The penetration-resistant material according to the present invention comprises at least one double layer consisting of two layers of woven fabric, which are non-cross-plied and optionally bonded together. The term "woven" includes all types of weaves, such as plain weave, satin weave, basket weave, twill weave and the like. Preferred fabrics are plain woven.

The penetration-resistant material according to the present invention may contain as little as one double layer consisting of two layers of woven fabric, but usually more double layers are applied. Suitable numbers of double layers are 5 to 100. Most preferably, 6 to 35 double layers are used. The first set of threads of the first fabric layer of a double layer may be parallel to, or at an angle to, the first set of threads of the first fabric layer of the adjacent double layer. If these sets are secured together under an angle, such an angle is preferably 90°.

As mentioned before, the double layers may be secured together using an adhesive layer or by stitching. Such adhesive layer may be made of the previously mentioned adhesive materials and has a thickness between 4 and 36 μm, preferably between 8 and 20 μm.

Methods of manufacture of the double layers are well known in the art. Usually the fabric is made by warping the warp yarn on a beam, followed by weaving on a loom. The single layer may optionally be impregnated or laminated and be subjected to a calendering or lamination process. At least two fabric layers can be bonded together by stitching, heating or applying pressure.

The invention pertains also to an article made of the penetration-resistant material of the present invention according to the methods known to the skilled man. Examples for such an article are bullet proof vests and armor plates.

The invention is further illustrated with the following examples.

EXAMPLE

A penetration-resistant material containing 22 double layers was manufactured by the following procedure.

The first layer of each double layer was produced from Twaron® 930 dtex ex Teijin Twaron in warp direction (9.5 threads/cm, water-repellant treated with OLEOPHOBOL SM® ex Ciba Spezialitätenchemie Pfersee GmbH, Langweid am Lech, DE) and polyester 140 dtex (Trevira® 710, ex Hoechst) in weft direction (2 threads/cm).

The second layer of each double layer was produced from polyester 140 dtex (Trevira®710, ex Hoechst) in warp direction (4 threads/cm) and Twaron®930 dtex ex Teijin Twaron in weft direction (9.5 threads/cm, water-repellant treated with OLEOPHOBOL SM®ex Ciba Spezialitätenchemie Pfersee GmbH, Langweid am Lech, DE). The warp/weft ratio of the first layer and the weft/warp ratio of the second layer was 6.6:1.

To prepare a double layer, the first and second layer were laminated together with 3 plies of a polyethylene film (LDPE, ex EKB) having a thickness of 10 μm, one sheet of polyethylene film being placed on both outer sides of the double layer and one sheet of polyethylene film being placed in-between each of the two fabric layers of the double layer. 22 double layers were prepared in this way.

Said 22 double layers separated from each other by a release paper were superimposed, placed in a press and pressed at a temperature of 120° C. and at a pressure of 25 bar during 25 minutes. Then, the heating of the press was switched off. Afterwards, the 22 double layers were separated from each other, the release paper was removed, and the 22 double layers were superimposed again to result in a penetration resistant material with a weight of about 4730 g/m$^2$.

Comparative Example

A penetration-resistant material with a weight of about 4730 g/m$^2$ was manufactured as in the example with the only difference that none of the threads were water-repellant treated.

$v_{50}$—determination $v_{50}$—values were determined with 9×19 Para type DM 11 A1B2 DAG bullets, wherein $v_{50}$ is the velocity at which 50% of the bullets are stopped and 50% of the bullets give full penetration. The penetration resistant material subjected to the $v_{50}$—determination was in the dry state. That means that said material was tested at room temperature and at a relative humidity of about 60%.

With each penetration-resistant material, two $v_{50}$ measurements were performed the results of which were averaged as shown in the following table.

| Penetration-resistant material of | $v_{50}$ (m/s) 1st measurement | $v_{50}$ (m/s) 2nd measurement | $v_{50}$ (m/s) averaged |
|---|---|---|---|
| example | 496 | 505 | 501 |
| comparative example | 483 | 492 | 488 |

The table shows that the penetration-resistant material of the example exhibits an averaged $v_{50}$—value which is 2.7% higher than that of the penetration-resistant material of the comparative example. Said difference in $v_{50}$ corresponds to a 5.4% higher energy absorption of the penetration-resistant material of the example if compared with the penetration-resistant material of the comparative example without any water-repellant treated threads.

Bundesmann Rain-Shower Test

The penetration-resistant materials according to the example and the comparative example were subjected to the Bundesmann rain-shower test (ISO 9865). The following table shows the weight percentage of water uptake after 10 minutes.

| Penetration-resistant material of | weight % water uptake |
|---|---|
| Example | 10.5 |
| comparative example | 34.4 |

The table shows that the penetration-resistant material of the example exhibits a water uptake which is only about a third of the water uptake of the penetration-resistant material of the comparative example without any water-repellant treated threads.

The invention claimed is:

1. A penetration-resistant material comprising at least a double layer of woven fabric wherein the double layer comprises a first layer of fabric and a second layer of fabric, wherein the first layer of fabric is composed of a first set of threads comprising 3.5 to 20 threads/cm, having a linear density of at least 210 dtex, and comprising at least 65% of the first layer fabric weight, and a second set of threads comprising 0.5 to 16 threads/cm and having a linear density of at least 50 dtex, with the second set of threads being transverse to the first set of threads, and a ratio of the number of threads/cm of the first set to that of the second set is greater than 1:1, wherein the second layer of fabric is composed of a first set of threads comprising 0.5 to 16 threads/cm and having a linear density of at least 50 dtex, and a second set of threads comprising 3.5 to 20 threads/cm, having a linear density of at least 210 dtex, and comprising at least 65% of the second layer fabric weight, with the second set of threads being transverse to the first set of threads, and a ratio of the number of threads/cm of the second set to that of the first set is greater than 1:1, wherein the first and second sets of threads of the first layer have a parallel orientation towards the first and second sets, respectively, of threads of the second layer, and wherein in the first layer of fabric at least the first set of threads, and in the second layer of fabric at least the second set of threads, are treated with a water-repellant, wherein the resulting treated threads have a water-repellant finish that is retained with the treated threads in the woven fabric.

2. The penetration-resistant material of claim 1, wherein in the first layer of fabric the first and the second set of threads, and in the second layer of fabric the first and the second set of threads, are treated with a water-repellant, wherein the resulting treated threads have a water-repellant finish that is retained with the treated threads in the woven fabric.

3. The penetration-resistant material of claim 1, wherein the water-repellant comprises fluorine and carbon atoms.

4. The penetration-resistant material of claim 3, wherein the water-repellant comprises a mixture of fluoroacrylate polymers.

5. The penetration-resistant material of claim 1, wherein the water-repellant treated threads comprise about 0.1 to about 2 weight % fluoroacrylate polymers with respect to the weight of the water-repellant treated threads.

6. The penetration-resistant material of claim 1, wherein at least the ratio of the linear density of the first set of threads to the linear density of the second set of threads of the first layer and of the linear density of the second set of threads to the linear density of the first set of threads of the second layer is greater than 1:1.

7. The penetration-resistant material of claim 6, wherein at least the ratio of the linear density of the first set of threads to the linear density of the second set of threads of the first layer and of the linear density of the second set of threads to the linear density of the first set of threads of the second layer is greater than 4.2:1.

8. The penetration-resistant material of claim 6, wherein at least the ratio of the linear density of the first set of threads to the linear density of the second set of threads of the first layer and of the linear density of the second set of threads to the linear density of the first set of threads of the second layer is greater than 5.9:1.

9. The penetration-resistant material of claim 1, wherein at least one of the second set of threads of the first layer and the first set of threads of the second layer comprises 0.5 to 8 threads/cm.

10. The penetration-resistant material of claim 1, wherein the threads of the layers of the double layer are bonded together.

11. The penetration-resistant material of claim 10, wherein the threads of the layers of the double layer are bonded together with an adhesive material.

12. The penetration-resistant material of claim 1, wherein the first set of threads of the first layer and the second set of threads of the second layer consist of high tenacity threads selected from aramid, polyethylene and poly-p-phenylenebenzobisoxazole (PBO) threads.

13. The penetration-resistant material of claim 1, wherein the second set of threads of the first layer and the first set of threads of the second layer are selected from polyester, polyethylene, polypropylene and aramid threads.

14. The penetration-resistant material of claim 1, wherein the first set of threads of the first layer and the second set of threads of the second layer consist of aramid threads, and the second set of threads of the first layer and the first set of threads of the second layer consist of polyester threads.

15. The penetration-resistant material of claim 1, wherein the linear density of the first set of threads of the first layer and of the second set of threads of the second layer is 210 to 6720 dtex.

16. The penetration-resistant material of claim 15, wherein the linear density of the first set of threads of the first layer and of the second set of threads of the second layer is 420 to 3360 dtex.

17. The penetration-resistant material of claim 15, wherein the linear density of the first set of threads of the first layer and of the second set of threads of the second layer is 420 to 1680 dtex.

18. The penetration-resistant material of claim 15, wherein the linear density of the first set of threads of the first layer and of the second set of threads of the second layer is 840 to 1100 dtex.

19. The penetration-resistant material of claim 1, wherein the linear density of the second set of threads of the first layer and of the first set of threads of the second layer is 50 to 280 dtex.

20. The penetration-resistant material of claim 19, wherein the linear density of the second set of threads of the first layer and of the first set of threads of the second layer is 80 to 140 dtex.

21. The penetration-resistant material of claim 1, wherein the first set of threads of the first layer and the first set of threads of the second layer are warp threads and the second set of threads of the first layer and the second set of threads of the second layer are weft threads.

22. The penetration-resistant material of claim 1, wherein the double layer exhibits two outer sides and at least one of the outer sides of the double layer is provided with a protective layer.

23. An article comprised of the penetration-resistant material of claim 1.

* * * * *

UNITED STATES PATENT AND TRADEMARK OFFICE

CERTIFICATE OF CORRECTION

PATENT NO. : 7,153,790 B2
APPLICATION NO. : 10/525195
DATED : December 26, 2006
INVENTOR(S) : Christian Kurt Bottger et al.

It is certified that error appears in the above-identified patent and that said Letters Patent is hereby corrected as shown below:

On Title Page Item 56

Under Foreign Application Priority Data, "(EP) 02020027" should be --(EP) 02020027.5--.

Column 5, line 36, "Trevira®710," should be --Trevira® 710,--.

Column 5, line 37, "Twaron®930" should be --Twaron® 930--.

Column 5, line 39, "SM®ex" should be --SM® ex--.

Signed and Sealed this

Thirteenth Day of March, 2007

JON W. DUDAS
*Director of the United States Patent and Trademark Office*